US007578095B2

(12) United States Patent
Peters

(10) Patent No.: US 7,578,095 B2
(45) Date of Patent: Aug. 25, 2009

(54) EMERGENCY ESCAPE WINDOW

(75) Inventor: Glen Peters, Box 23296, Grand Prairie, AB (CA) T8V 7G7

(73) Assignees: Glen Peters, Grand Prairie (CA); Timothy Peters, Grand Prairie (CA)

( * ) Notice: Subject to any disclaimer, the term of this patent is extended or adjusted under 35 U.S.C. 154(b) by 121 days.

(21) Appl. No.: 11/672,791

(22) Filed: Feb. 8, 2007

(65) Prior Publication Data

US 2007/0199245 A1 Aug. 30, 2007

(30) Foreign Application Priority Data

Feb. 10, 2006 (CA) ..... 2537368

(51) Int. Cl.
*E05B 65/10* (2006.01)

(52) U.S. Cl. ..... 49/141

(58) Field of Classification Search ..... 49/141, 49/463, 564

See application file for complete search history.

(56) References Cited

U.S. PATENT DOCUMENTS

| | | | | |
|---|---|---|---|---|
| 2,102,250 | A | 12/1937 | Zeeb | |
| 2,548,250 | A | 4/1951 | Allen | |
| 2,554,442 | A | 5/1951 | Ehret | |
| 2,572,124 | A | 10/1951 | Eichner | |
| 2,639,790 | A | 5/1953 | Reitzel | |
| 2,660,274 | A | 11/1953 | Donathan | |
| 2,670,062 | A | 2/1954 | Carbiener | |
| 2,701,631 | A | 2/1955 | Stouder | |
| 2,787,348 | A | 4/1957 | Goodemote | |
| 2,793,722 | A | 5/1957 | Bingham | |
| 3,431,677 | A | 3/1969 | Ehret | |
| 3,797,167 | A | 3/1974 | Gomboc | |
| 4,106,236 | A | 8/1978 | Oliphant | |
| 4,237,654 | A | 12/1980 | Landem | |
| 4,327,523 | A | 5/1982 | Gravely | |
| 4,377,055 | A * | 3/1983 | Frederick | 49/388 |
| 4,424,646 | A | 1/1984 | Adams | |
| 4,495,728 | A | 1/1985 | Lynn | |
| 4,497,512 | A * | 2/1985 | Sherrow | 292/92 |
| 4,631,862 | A | 12/1986 | Gallardo | |
| 4,677,789 | A | 7/1987 | Merry | |
| 4,839,988 | A | 6/1989 | Betts | |
| 4,897,961 | A * | 2/1990 | Shine | 49/141 |

(Continued)

FOREIGN PATENT DOCUMENTS

| | | |
|---|---|---|
| CA | 833955 | 2/1970 |

*Primary Examiner*—Jerry Redman
(74) *Attorney, Agent, or Firm*—Christensen O'Connor Johnson Kindness PLLC

(57) ABSTRACT

An emergency escape window includes an inner frame positioned within an opening of an outer frame which is large enough to permit a person to escape through it. Latch openings are provided in the outer frame. Latch receivers are secured to an outer peripheral edge of the inner frame in alignment with each of the latch openings. Latch members are positioned within each of the latch openings. The latch members are being movable between a locking position and a release position. In the locking position, the latch members are engaged with the latched receivers to preclude movement of the inner frame relative to the outer frame. In the release position, the latch members are disengaged from the latch receivers and the inner frame is freely movable relative to the outer frame, such that the inner frame can be removed to permit escape through the opening of the outer frame.

5 Claims, 4 Drawing Sheets

U.S. PATENT DOCUMENTS 5,103,591 A 4/1992 Szymanski
5,169,205 A 12/1992 James
5,192,244 A * 3/1993 Rose ..... 454/276
5,255,479 A 10/1993 Shepherd
5,327,682 A * 7/1994 Holtz ..... 49/463
5,410,841 A * 5/1995 Harris et al. ..... 49/67
5,746,026 A * 5/1998 Brede et al. ..... 49/506
5,850,710 A 12/1998 Brock
6,102,155 A 8/2000 Hood
6,308,918 B1 10/2001 Ferrier
6,382,685 B1 * 5/2002 Hammond ..... 292/145
6,427,383 B1 * 8/2002 Brooks et al. ..... 49/141
6,481,158 B1 * 11/2002 Marks ..... 49/57
6,510,654 B1 1/2003 McCracken
6,578,664 B1 6/2003 Doherty
6,588,154 B1 7/2003 Miller
6,688,659 B2 2/2004 Kobrehel
6,786,005 B1 * 9/2004 Williams ..... 49/141

* cited by examiner

EMERGENCY ESCAPE WINDOW

FIELD OF THE INVENTION

The present invention relates to a window that has means to permit escape in the event of an emergency.

BACKGROUND OF THE INVENTION

U.S. Pat. No. 5,255,479 (Shepherd 1993) entitled "Emergency Escape Hatch" identifies a need for persons to have a rapid means of escape in the event of a fire of other emergency.

SUMMARY OF THE INVENTION

An emergency escape window, which includes an outer frame and an inner frame. The outer frame has four or more sides which define an opening large enough to permit a person to escape through the opening. The outer frame is adapted for fixed installation in a wall of a building. Latch openings are provided through at least two opposed sides of sides of the outer frame. The inner frame has a like number of sides as the outer frame. The sides of the inner frame define an opening. The inner frame is positioned in the opening of the outer frame. Either a transparent or translucent substrate is positioned in the opening of the inner frame. Latch receivers are secured to an outer peripheral edge of the inner frame in alignment with each of the latch openings. Latch members are positioned within each of the latch openings. The latch members are being movable between a locking position and a release position. In the locking position, the latch members are engaged with the latched receivers to preclude movement of the inner frame relative to the outer frame. In the release position, the latch members are disengaged from the latch receivers and the inner frame is freely movable relative to the outer frame, such that the inner frame can be removed to permit escape through the opening of the outer frame. According to the present invention there is provided

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
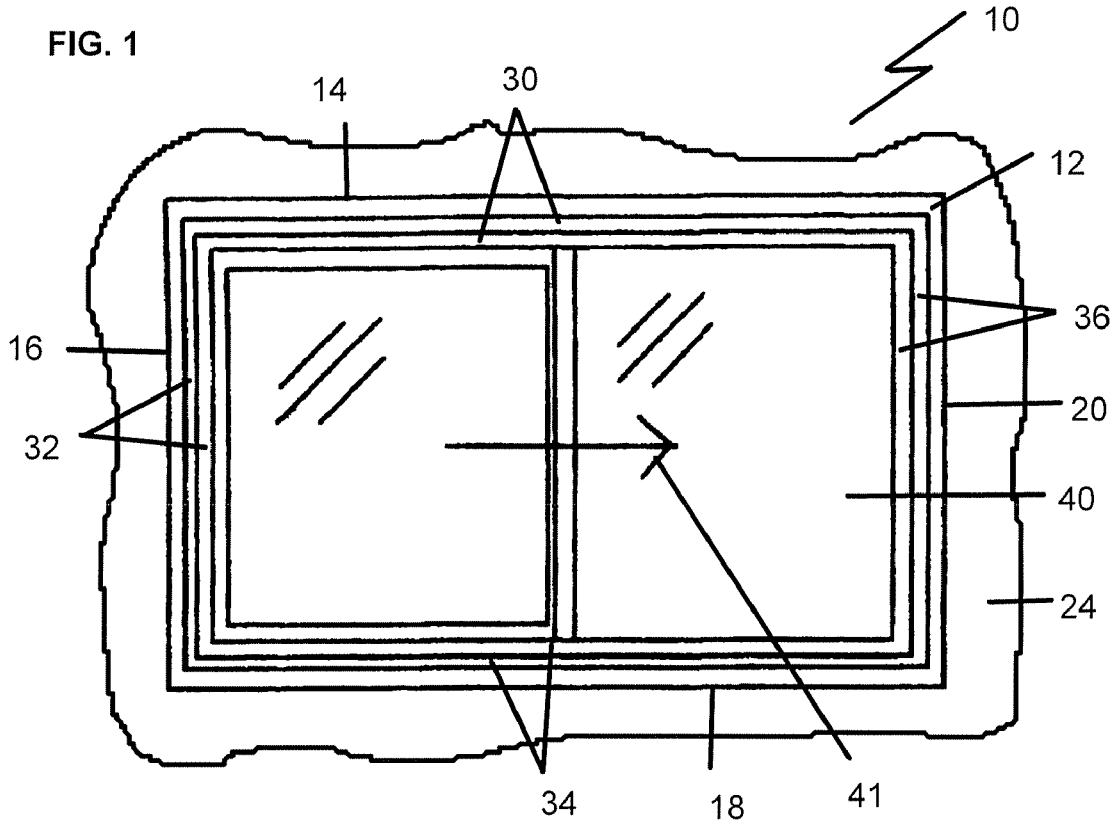
FIG. 1 is an elevation view of an emergency escape window constructed in accordance with the teachings of the present invention as viewed from the outside of a building.

The preferred embodiment, an emergency escape window generally identified by reference numeral 10, will now be described with reference to FIGS. 1 through 7.

Figure 3:
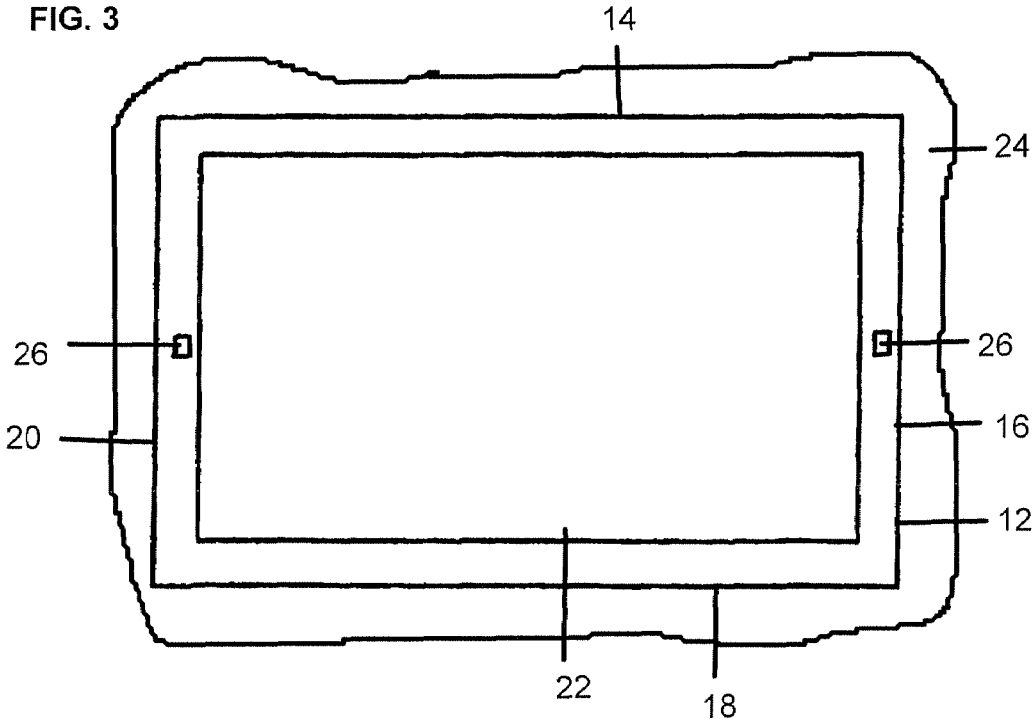
FIG. 3 is an elevation view of the outer frame of the emergency escape window illustrated in FIG. 2.

Structure and Relationship of Parts:

Referring to FIG. 1, the emergency escape window 10, has an outer frame 12 which is adapted for fixed installation in a wall 24 of a building. Referring to FIG. 3, the outer frame 12 has four sides 14, 16, 18 and 20 that define an opening 22. Opening 22 must be large enough to provide a means of escape for a person. Sides 16 and 20 of outer frame 12 have latch openings 26 that go right through the outer frame 12.

Figure 2:
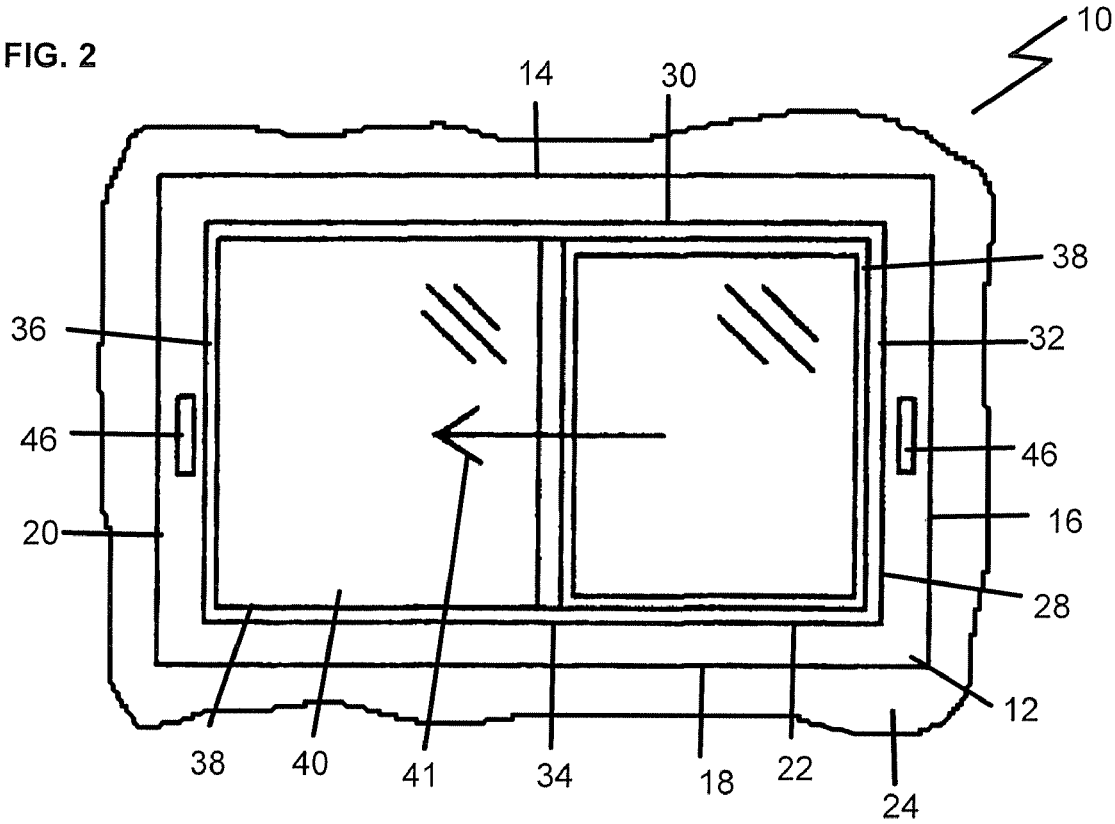
FIG. 2 is an elevation view of the emergency escape window illustrated in FIG. 1, as viewed from the inside of the building.

Referring to FIG. 2, an inner frame 28 has sides 30, 32, 34 and 36 that define an opening 38. The inner frame 28 is positioned in opening 22 of outer frame 12. A two part sliding window glass 40 is positioned within opening 38 of inner frame 28. The sliding of window glass 40 is indicated by arrow 41.

Figure 5:
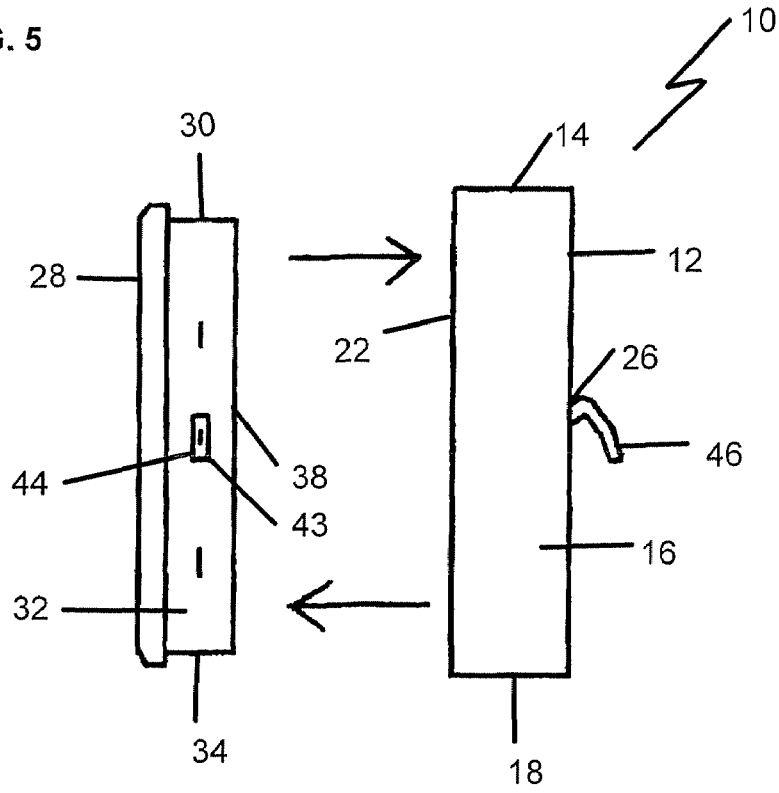
FIG. 5 is an exploded side elevation view of the emergency escape window illustrated in FIG. 1.
Figure 6:
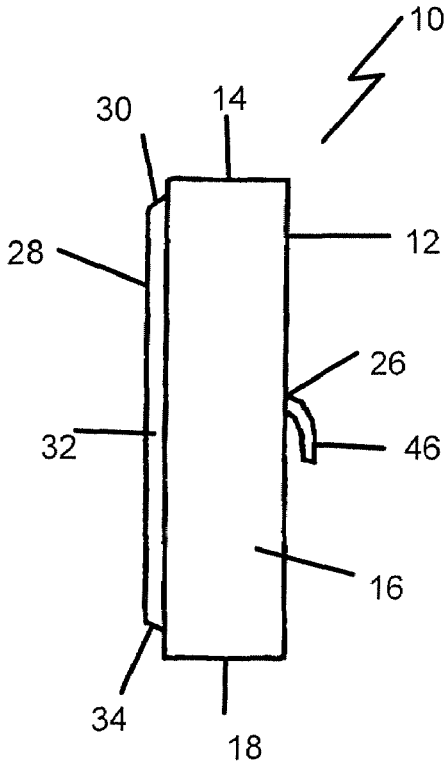
FIG. 6 is a side elevation view of the emergency escape window illustrated in FIG. 1.
Figure 7:
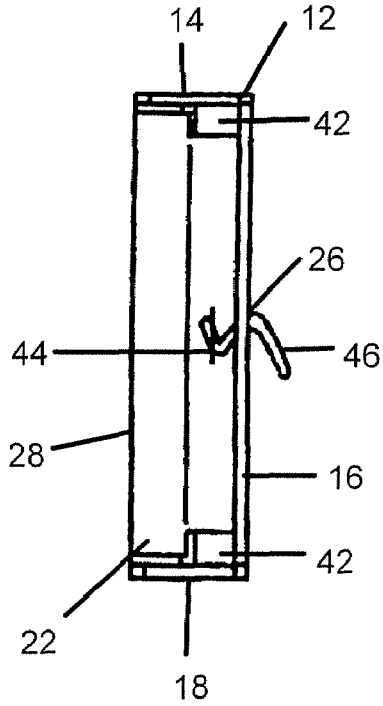
FIG. 7 is a side elevation view, in section, of the emergency escape window illustrated in FIG. 1.

Referring to FIG. 7, the stops 42 on outer frame 12 prevent inward movement of inner frame 28 relative to outer frame 12, such that inner frame 28 must be pushed outwardly to permit escape. As depicted in FIG. 5 latch receivers 44 are secured to an outer peripheral edge 43 of sides 32 and 36 of inner frame 28 in alignment with each of latch openings 26. Referring to FIG. 7, latch members 46 are positioned within each of the latch openings 26. Latch members 46 are pivotally movable between a locking position and a release position. In the locking position, latch members 46 are engaged with the latch receivers 44 to preclude movement of inner frame 28 relative to outer frame 12. Referring to FIG. 5, in the release position latch members 46 are disengaged from latch receivers 44 and the inner frame 28 is freely movable relative to the outer frame 12, such that the inner frame 28 can be pushed outwardly to permit escape through the opening 22 of outer frame 12.

Figure 4:
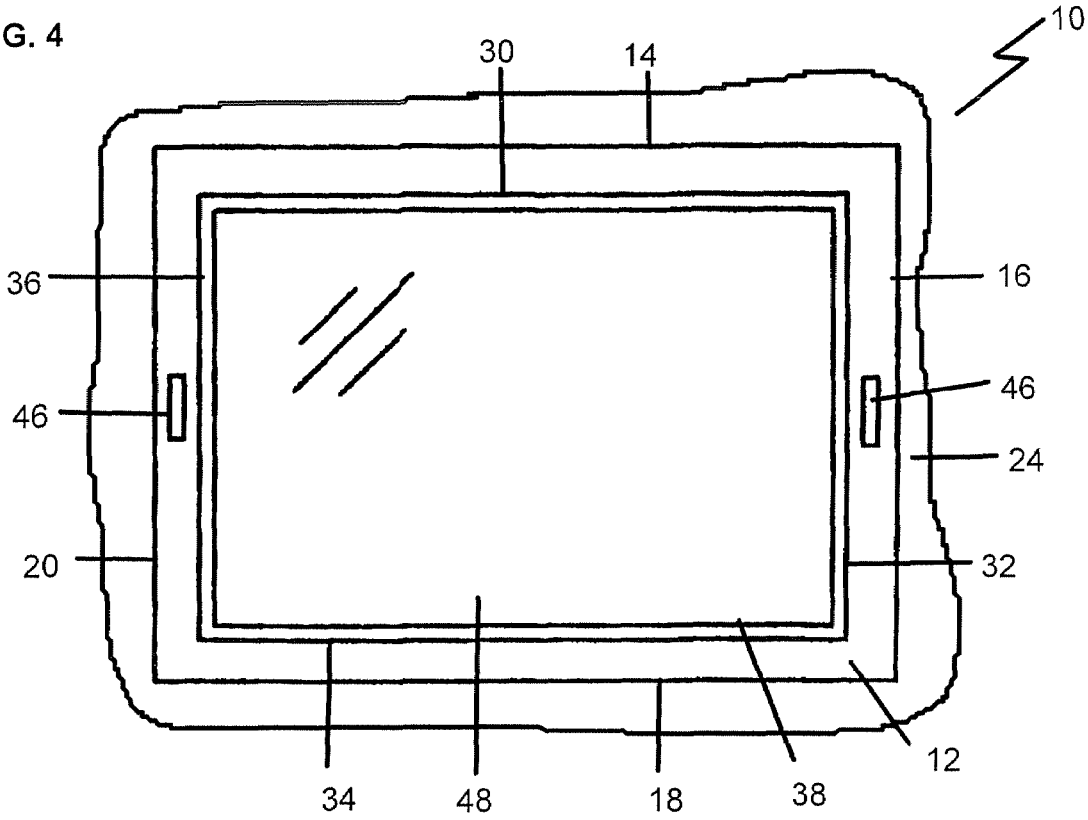
FIG. 4 is an elevation view of the emergency escape window illustrated in FIG. 2, with a single pane of glass.

It will be appreciated that the configuration of window glass is not relevant to the present invention. FIG. 1 depicts a two part sliding window. 40 positioned in opening 38 of inner frame 28. FIG. 4 depicts a picture glass window frame 48 is positioned in opening 38 of inner frame 28.

Operation:

The use and operation of emergency escape window will now be described with reference to FIG. 1 through FIG. 7. Referring to FIG. 1, outer frame 12 of emergency escape window 10 is installed in an opening in wall 24 of a building. Referring to FIG. 7, outer frame 12 is placed in wall 24 opening orientated so that stops 42 are towards the inside of the building. Referring to FIG. 5, inner frame 28 is placed within opening 22 of outer frame 12 from outside the building. Referring to FIG. 7, inner frame 28 and outer frame 12 are held together by latch members 46 which go through latch openings 26 the internal side of outer frame 12 and into latch receivers 44 on peripheral edge 43 of inner frame 28. When latch members 46 are down, in the locked position, inner frame 28 and outer frame 12 are secured together and emergency escape window 10 functions as a regular window. Inner frame 28 abuts stops 42 on outer frame 12, therefore inner frame 28 can not be pushed into the building. Referring to FIG. 5, when latch members 46 are up in the unlocked position, inner frame 28 can be pushed out of outer frame 12 towards the outside of the building. Of course, this would only be done in the event of an emergency. When inner frame 28 has been removed from opening 22 a person can climb through opening 22 and escape through emergency escape window 10.

Variations:

The emergency escape window selected for illustration is a "standard" four sided window. It will be appreciated that multi-sided polygon windows, although less common, are well known. There is no reason why the teachings of the present invention could not be applied to a window having more than four sides.

The emergency escape window selected for illustration shows latch openings on the sides of the outer frame and latch receivers on the sides of the inner frame. It will be appreciated that the latch openings and latch receivers could be on the top and bottom, or on all sides of the outer frame and the inner frame respectively.

Figure 8:
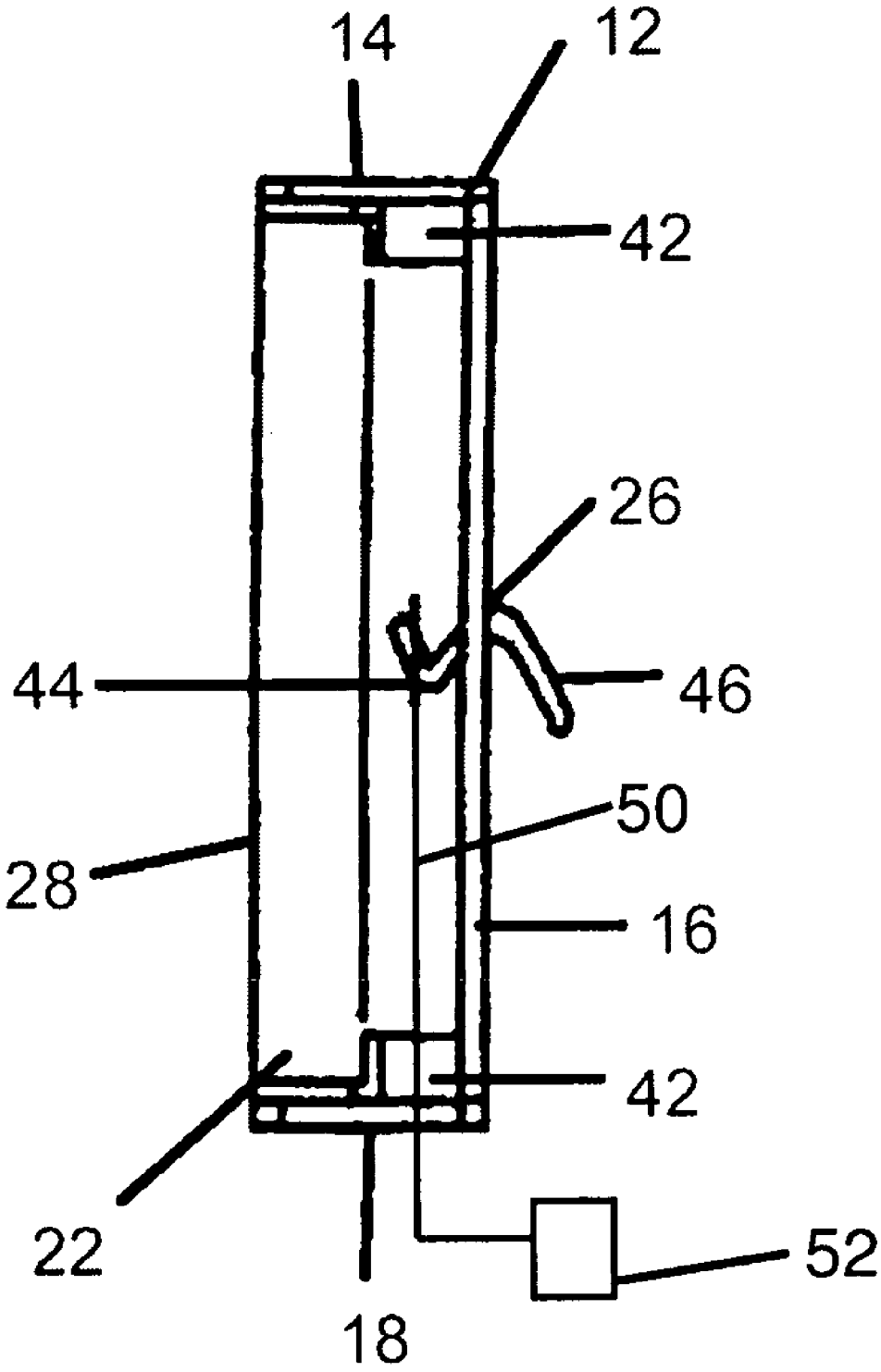
FIG. 8 is a side elevation view, in section, of a variation of the emergency escape window illustrated in FIG, 1.

Referring to FIG. 8. the emergency escape window may be connected to an alarm circuit 50, such that when the window 10 is opened, for example, when the latch 46 is moved to the open position, an alarm 52 is sounded. This allows the household to be alerted in the event of an emergency requiring evacuation, and in the event of an intrusion.

Also, wherein one or mire latch members of the escape window may be connected to the alarm circuit, such that the alarm is triggered when the one or more latch members are moved to the release position.

If the alarm 52 is located at the window 10, the other members of the household can the sound to the open window.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. An emergency escape window, comprising:

an outer frame having at least four sides which define an opening, the outer frame being adapted for fixed installation in a wall of a building, the opening being large enough to permit a person to escape through the opening;

latch openings through at least two opposed sides of the at least four sides of the outer frame;

an inner frame, having a like number of sides as the outer frame, the sides of the inner frame defining an opening, the inner frame being positioned in the opening of the outer frame;

one of a transparent or translucent substrate being positioned in the opening of the inner frame;

latch receivers secured to an outer peripheral edge of the inner frame in alignment with each of the latch openings;

latch members positioned within each of the latch openings, the latch members being movable between a locking position and a release position, in the locking position the latch members are engaged with the latched receivers to preclude movement of the inner frame relative to the outer frame, the inner frame being secured to the outer frame solely by the latch members engaged with the latch receivers, in the release position the latch members are disengaged from the latch receivers and the inner frame is disengaged from, and freely movable relative to the outer frame, such that the inner frame can be removed to permit escape through the opening of the outer frame.

2. The emergency escape window as defined in claim 1, wherein stops are provided to prevent inward movement of the inner frame relative to the outer frame, such that the inner frame is pushed outwardly to permit escape.

3. The emergency escape window as defined in claim 1, wherein one or more latch members are connected to an alarm circuit, such that an alarm is triggered when the one or more latch members are moved to the release position.

4. The emergency escape window of claim 1, wherein the inner frame contains a sliding window.

5. An emergency escape window, comprising:

an outer frame having four sides which define an opening, the outer frame being adapted for fixed installation in a wall of a building, the opening being large enough to permit a person to escape through the opening;

latch openings through at least two opposed sides of the four sides of the outer frame;

an inner frame, having a like number of sides as the outer frame, the sides of the inner frame defining an opening, the inner frame being positioned in the opening of the outer frame;

window glass being positioned in the opening of the inner frame;

stops between the outer frame and the inner frame to prevent inward movement of the inner frame relative to the outer frame, such that the inner frame must be pushed outwardly to permit escape;

latch receivers secured to an outer peripheral edge of the inner frame in alignment with each of the latch openings;

latch members positioned within each of the latch openings, the latch members being movable between a locking position and a release position, in the locking position the latch members are engaged with the latched receivers to preclude movement of the inner frame relative to the outer frame, in the release position the latch members are disengaged from the latch receivers and the inner frame is freely movable relative to the outer frame, such that the inner frame can be push outwardly to permit escape through the opening of the outer frame.

* * * * *